United States Patent [19]

Itoh

[11] Patent Number: 4,897,962

[45] Date of Patent: Feb. 6, 1990

[54] DOOR APPARATUS

[76] Inventor: Mituru Itoh, No. 2-6, Inohana 3-chome, Chiba-shi, Chiba-ken, Japan

[21] Appl. No.: 210,693

[22] Filed: Jun. 23, 1988

[30] Foreign Application Priority Data

Oct. 2, 1988 [JP] Japan ..... 63-29735

[51] Int. Cl.[4] ..... E05D 15/56

[52] U.S. Cl. ..... 49/208; 49/246; 49/260

[58] Field of Search ..... 49/208, 246, 248, 260

[56] References Cited

U.S. PATENT DOCUMENTS 1,276,431 8/1918 Smith ..... 49/260 X

FOREIGN PATENT DOCUMENTS 1285896 1/1962 France ..... 49/246

741432 12/1955 United Kingdom ..... 49/248

*Primary Examiner*—James R. Brittain

*Attorney, Agent, or Firm*—Armstrong, Nikaido, Marmelstein, Kubovcik & Murray

[57] ABSTRACT

Disclosed herein is a novel door apparatus of the type wherein one door rotates while moving horizontally to the right and left, becomes parallel to the sidewall of an entrance, thereby being opened fully, then reverses in the original direction while moving horizontally and is then closed. The door apparatus of the invention is most suitable for an entrance having a limited width or for the handicapped or those who use a wheel chair because they have difficulty in passing through conventional swing type doors.

1 Claim, 7 Drawing Sheets

DOOR APPARATUS

BACKGROUND OF THE INVENTION

1. Field of the Invention

This invention relates to a door apparatus and more particularly, to a novel door apparatus of the type wherein one door rotates while moving horizontally to the right and left when it is opened, then becomes in parallel with the sidewall of an entrance, thereby being opened fully, and moves once again to the original direction and is closed.

2. Description of the Prior Art

Conventional doors in general have a structure when the right or left side portion of the door are pivotally fitted to the sidewall of an entrance by hinges. Therefore, when one opens the door, the door swings greatly with the hinges being the support point. Since the door swings greatly and opens, one must take a step backward when he pulls the door towards him. Generally, one does not open fully the door but passes through it. In such a case, one must pass while turning sideways.

Since the conventional door has the structure described above, the door cannot be opened and closed smoothly particularly by the handicapped or those who use a wheelchair and they have difficulty in opening and closing the door.

SUMMARY OF THE INVENTION

In order to eliminate the problems with the conventional door described above, the present invention contemplates to provide a novel door apparatus of the type wherein one door rotates while moving horizontally to the right or left, opens fully when it becomes parallel to the sidewall of an entrance, moves horizontally while reversing to the original direction and is thereafter closed, and which eliminates the trouble of taking a step backward or turning sideways when opening the door.

The above and other objects and novel features of the present invention will become more apparent from the following detailed description when taken in conjunction with the accompanying drawings.

DESCRIPTION OF THE PREFERRED EMBODIMENTS

Figure 1:
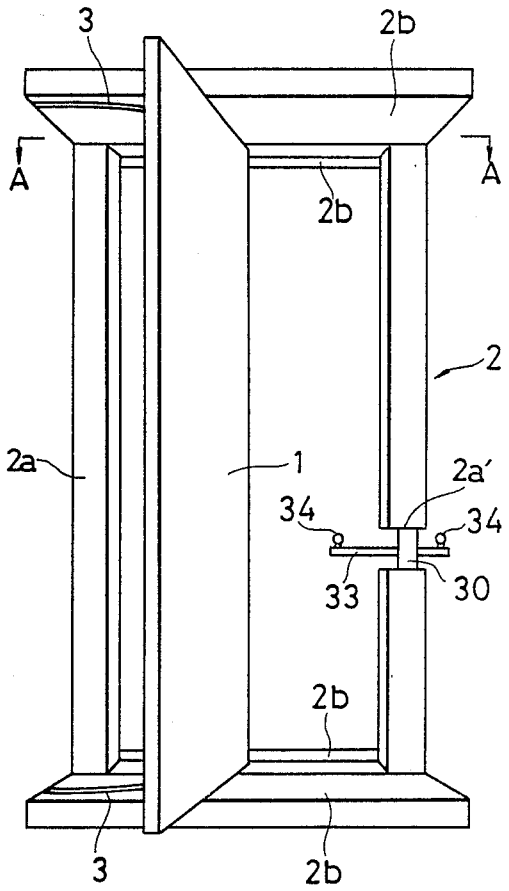
FIG. 1 is an overall perspective view of the door apparatus in accordance with the present invention.
Figure 2:
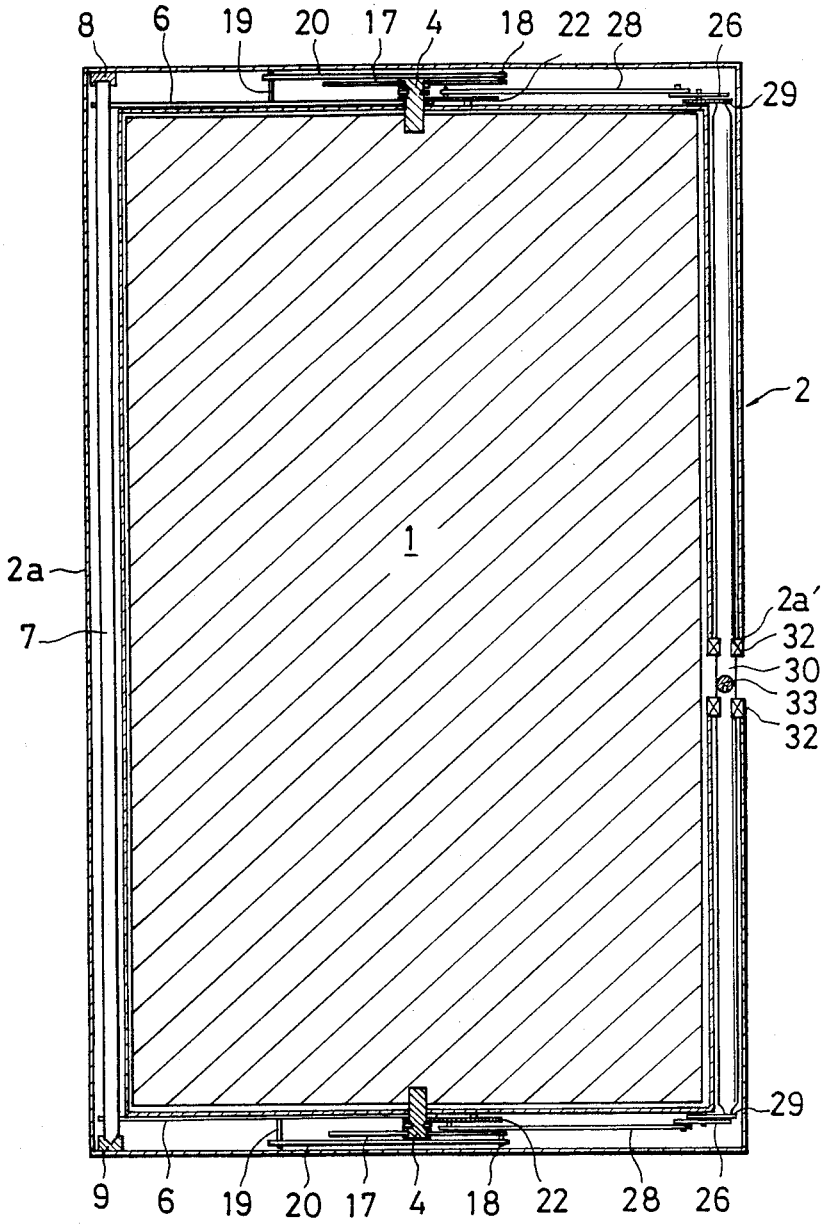
FIG. 2 is an enlarged, longitudinal sectional front view at the center of the door apparatus.
Figure 3:
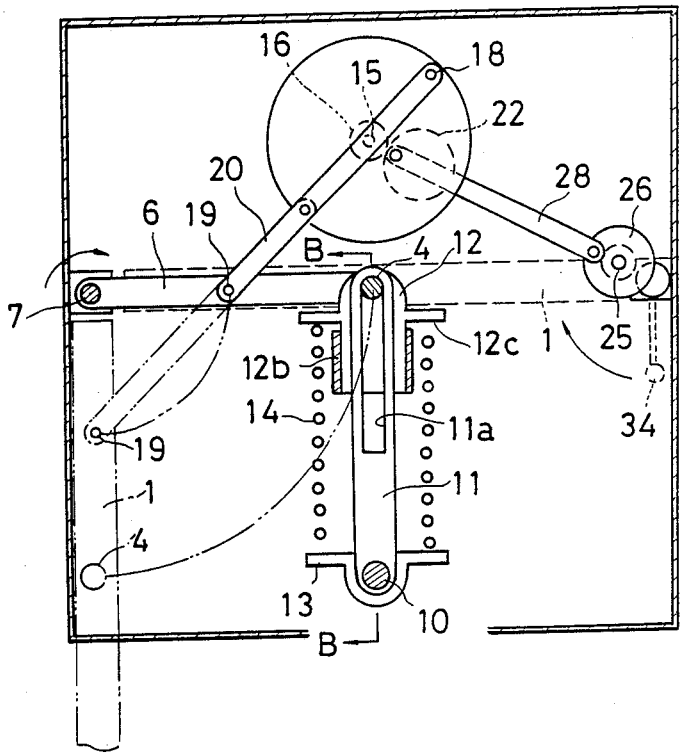
FIG. 3 is an enlarged sectional view taken along line A—A of FIG. 1.
Figure 4:
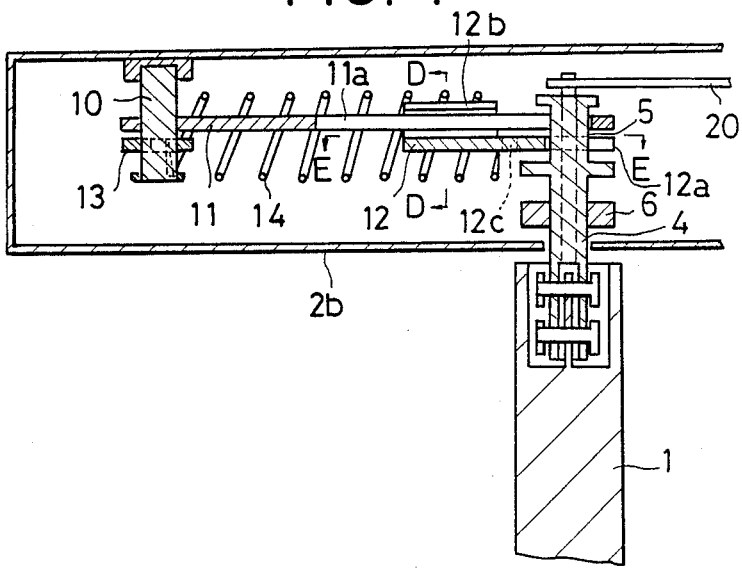
FIG. 4 is an enlarged sectional view taken along line B—B of FIG. 3.
Figure 5:
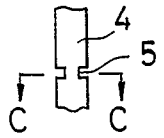
FIG. 5 is a partial enlarged front view of a door support shaft portion.

In the drawings, reference numeral 1 represents one door having a predetermined width. Reference numeral 2 represents a frame for supporting the door 1. It consists of a rectangular main frame 2*a* incorporating therein main shaft and door operation shaft and sub-frames 2*b*, 2*b* move integrally back and forth from the upper and lower portions of the main frame 2*a* and incorporating therein horizontal rocking rod, disc, and so forth. An arcuate groove 3 is formed on the sub-frame 2*b* along the moving orbit of a door support shaft 4 which will later be described.

Substantially the center 2*a*′ of the main frame 2*a* on the side where a later-appearing operation shaft is stored is cut in a predetermined length so as to expose partly the operation shaft.

Figure 6:
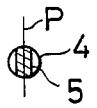
FIG. 6 is a sectional view taken along line C—C of FIG. 5.
Figure 7:
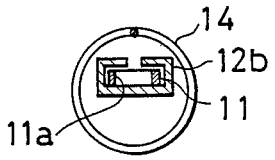
FIG. 7 is a sectional view taken along line D—D of FIG. 4.
Figure 8:
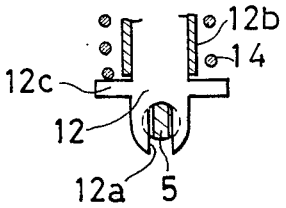
FIG. 8 is a sectional view taken along line E—E of FIG. 4.
Figure 9:
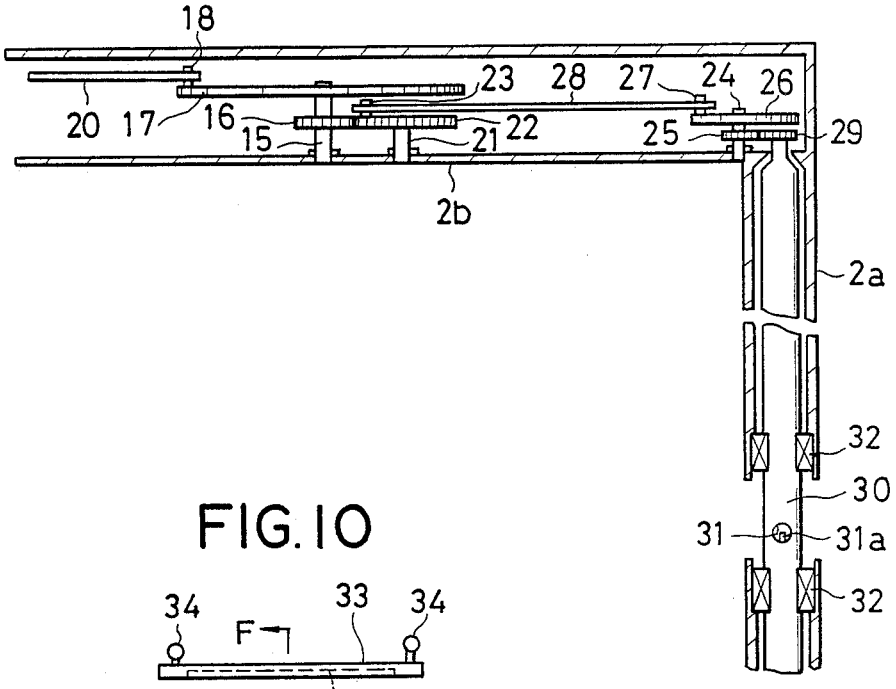
FIG. 9 is a partial enlarged sectional view of a frame.
Figure 10:
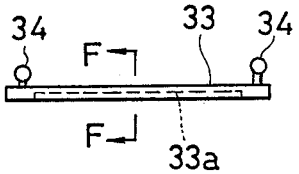
FIG. 10 is a front view of an operation rod.
Figure 11:
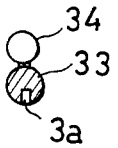
FIG. 11 is an enlarged sectional view taken along line F—F of FIG. 10.

Reference numerals 4, 4 represent door support shafts which project vertically from the upper and lower center of the door 1 in the transverse direction. The tip of each door support shaft 4 is supported rotatably by the tip of a later-appearing support arm. Part of the circumferential surface of each door support shaft is cut off in such a manner as to leave a shaft portion 5 having a width corresponding to a notch groove of a later-appearing rotation limit plate. The axis (P in FIG. 6) of the shaft portion 5 crosses at right angles the door 1.

Reference numerals 6, 6 represent support arms which support rotatably the door support shafts 4, 4, respectively. Each support arm moves horizontally from the upper or lower end of a later-appearing main shaft and rocks horizontally with the main shaft being the support point.

Reference numeral 7 represents the main shaft described above. It is stored in the vertical portion of the main frame 2*a* and is supported rotatably by suitable bearing members 8 and 9.

Reference numerals 10, 10 represent support shafts which are fixed vertically inside the sub-frame 2*b*. Each support shaft supports rotatably the base portion of a horizontal rocking rod in the horizontal direction. The support shaft 10 is fixed at a position where lines connecting the axis of the support shaft 10, the axis of the main shaft 7 and the axis of the door support shaft 4 describe a regular triangle.

Reference numerals 11, 11 represent horizontal rocking rods, whose base portions are supported rotatably by the support shafts 10, 10 described above, respectively. Each rod is equipped with an elongated hole 11*a* which extends from the tip to the substantial center of the rocking rod and into which the tip of the door support shaft 4 fits slidably.

Reference numerals 12, 12 represent rotation limit plates, each of which is equipped at the tip thereof with a notch groove 12*a* having a predetermined width in match with the elongated hole 11*a* of the horizontal rocking rod 11 and at the rear end thereof with a frame portion 12*b* into which the horizontal rocking rod 11 fits slidably. A spring receiving portion 12*c* is formed projectingly on the side of each rotation limit plate 12. Incidentally, the shaft portion 5 of the door support shaft 4 is fitted into the notch groove 12*a*.

Reference numerals 13, 13 represent spring receiving members which are rotatably fitted to the support shaft 10.

Reference numerals 14, 14 represent bias springs which are interposed between the spring receiving members 13 and the spring receiving portions 12c of the rotation limit plates 12. Each spring normally pushes the rotation limit plate 12 to the door support shaft 4.

Reference numerals 15, 15 represent rotary shafts, each of which is disposed vertically in the sub-frame 2b on the side opposite to the support shaft 10. A first small gear 16 and a disc 17 having a predetermined diameter are fixed to each rotary shaft 15. The disc 17 rocks the support arm 6 through a later-appearing connecting rod and its diameter is such that when a pin 18 implanted thereto moves by 180°, the support arm 6 rocks by 90° with the main shaft 7 being the support point.

A pin 18 is implanted to an eccentric position of the disc 17. The position of implantation of this pin 18 is selected so that when the door 1 is closed, the pin 18 is positioned on the line connecting the center of the rotary shaft 15 to the center of a pin 19 implanted to the support arm 6.

Reference numerals 19, 19 represent the pins described above. Each pin 19 is implanted to the substantial center of each support arm 6 in its longitudinal direction. More precisely, the pin 19 is implanted to the portion which correspnds to ¼ of the entire width of the door 1.

Reference numerals 20, 20 represent connecting rods. On of the ends of each connecting rod 20 is connected pivotally to the disc 17 through the pin 18 described above and its other end, to the support arm 6 through the pin 19 described above.

Reference numerals 21, 21 represent rotary shafts which are disposed vertically inside the sub-frame 2b. A second small gear 22 meshing with the afore-mentioned first small gear 16 is fixed to each rotary shaft 21. The diameter of the second small gear 22 is twice the diameter of the first small gear 16.

A pin 23 is implanted at an eccentric position of each second small gear 22. Incidentally, the position of implantation of this pin 23 is selected so that when the door 1 is open, it is positioned on the line connecting the center of the rotary shaft 21 to the center of a rotary shaft 24 of a later-appearing third small gear.

Reference numerals 24, 24 represent rotary shafts disposed vertically on the main frame 2a. A third small gear 25 meshing with a fourth small gear fixed to a later-appearing operation shaft and a disc 26 are fixed to each rotary shaft 24. The diameter of the third small gear 25 is equal to that of the first small gear 16 and the diameter of the disc 26 is equal to that of the second small gear 22.

A pin 27 is implanted to an eccentric position of the disc 26. the position of implantation of this pin 27 is selected so that when the door 1 is open, it is positioned on the line connecting the center of the rotary shaft 24 to the center of the rotary shaft 21 of the second small gear.

Reference numerals 28, 28 represent connecting rods. One of the ends of each connecting rod 28 is pivotally connected to the second small gear 22 through the pin 23 and its other end, to the disc 26 through the pin 27.

Reference numerals 29, 29 represent fourth small gears fixed to the upper and lower end portions of a later-appearing operation shaft. They mesh with the third small gears 25. The diameter of the fourth small gear 29 is equal to those of the first and third small gears 16 and 25.

Reference numeral 30 represents an operation shaft, which is equipped substantially at its center with a fitting hole 31 of a later-appearing operation rod and which is stored in the vertical portion of the main shaft 2a and supported rotatably by a suitable bearing member 32. A key 31a is disposed inside the fitting hole 31 of the operation rod. The fitting hole 31 of the operation rod is bored so that when the door 1 is closed, the operation rod crosses the door 1 at right angles.

Reference numeral 33 represents an operation rod, which is equipped at its both end portions with knobs 34, 34, and which is fitted slidably into the fitting hole 31 of the operation rod. A key groove 33a, into which the key 31a described above fits, is formed on the operation rod 33.

Next, the operation of the door appartus of the present invention having the above-mentioned construction will be described.

When one approaches the door 1, he pulls the operation rod 33 towards him by gripping the knob 34. When he pushes the knob 34 towards the center of the door 1 while gripping it, the operation shaft 30 rotates.

Figure 12:
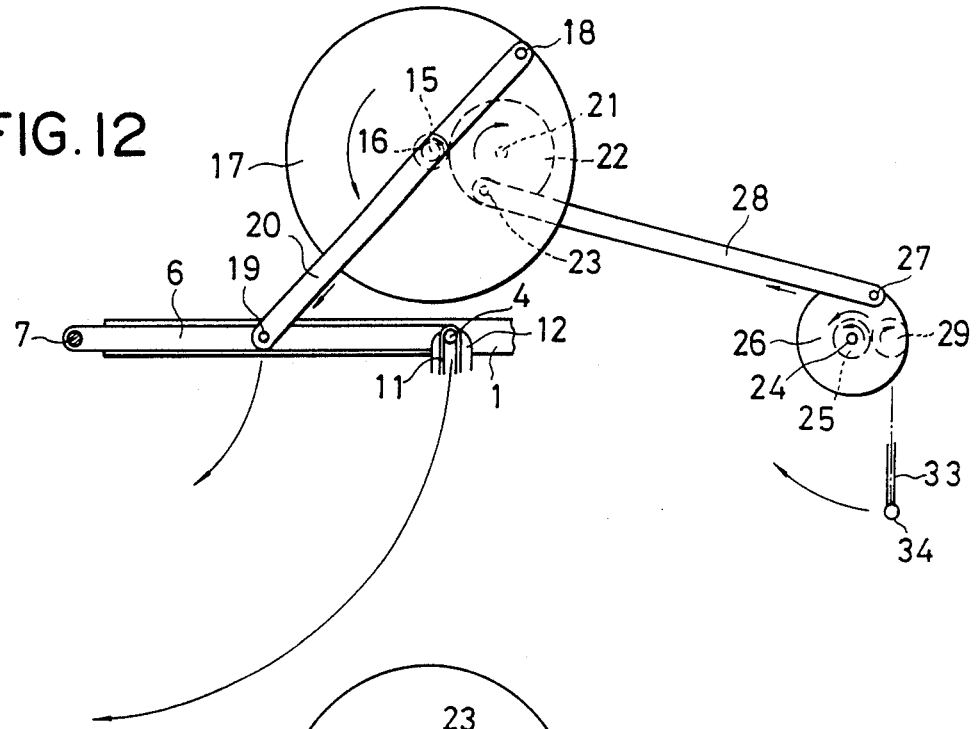
FIGS. 12 to 14 are explanatory views, each useful for explaining the door operation.

FIG. 12 shows the state at this time. In the drawing, when the operation shaft 30 rotates, the fourth small gear 29 fixed to it rotates clockwise (in the direction represented by arrow) and rotates counter-clockwise the third small gear 25 meshing with it. When the third small gear 25 rotates, the disc 26 rotates through the rotation of the rotary shaft 24 and pushes out the connecting rod 28 towards the disc 17.

When the pin 23 is pushed out by the connecting rod 28, the second small gear 22 rotates clockwise and lets the first small gear 16 meshing with it rotate counter-clockwise. When the first small gear 16 rotates, the disc 17 rotates through the rotary shaft 15 and moves the pin 18 implanted thereto in such a manner as to describe a semi-circle.

Accordingly, the connecting rod 20 is pushed towards the door 1 and its end portion pushes out the pin 19 so that the support arm 6 starts rocking horizontally in the direction represented by an arrow with the main shaft 7 being the center.

When the support arm 6 rocks as described above, the door support shaft 4 supported rotatably at the tip of the support arm 6 moves forward while describing an arcuate orbit with the main shaft 7 being the center. At this time, the door support shaft 4 moves forward gradually while sliding inside the elongated hole 11a of the horizontal rocking rod 11 but the rotation of the door support shaft 4 itself is checked by the rotation limit plate 12 which is supported movably in the axial direction by the horizontal rocking rod 11 and biased to the door support shaft 4 by the bias spring 14. In other words, the axis P of the shaft portion 5 of the door support shaft 4 is kept always in agreement with the support shaft 10.

Figure 15:
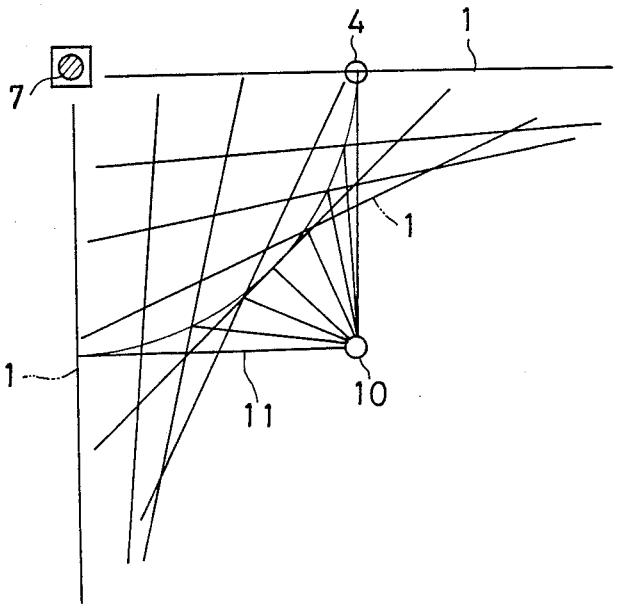
FIG. 15 is an explanatory view useful for explaining the moving orbit of the door.

Accordingly, with the forward movement of the door support shaft 4, the door 1 moves horizontally and outward, changes its moving direction, becomes at right angles to the original position or in parallel with the sidewall of the entrance (not shown) and is open, as shown in FIG. 15.

Figure 13:
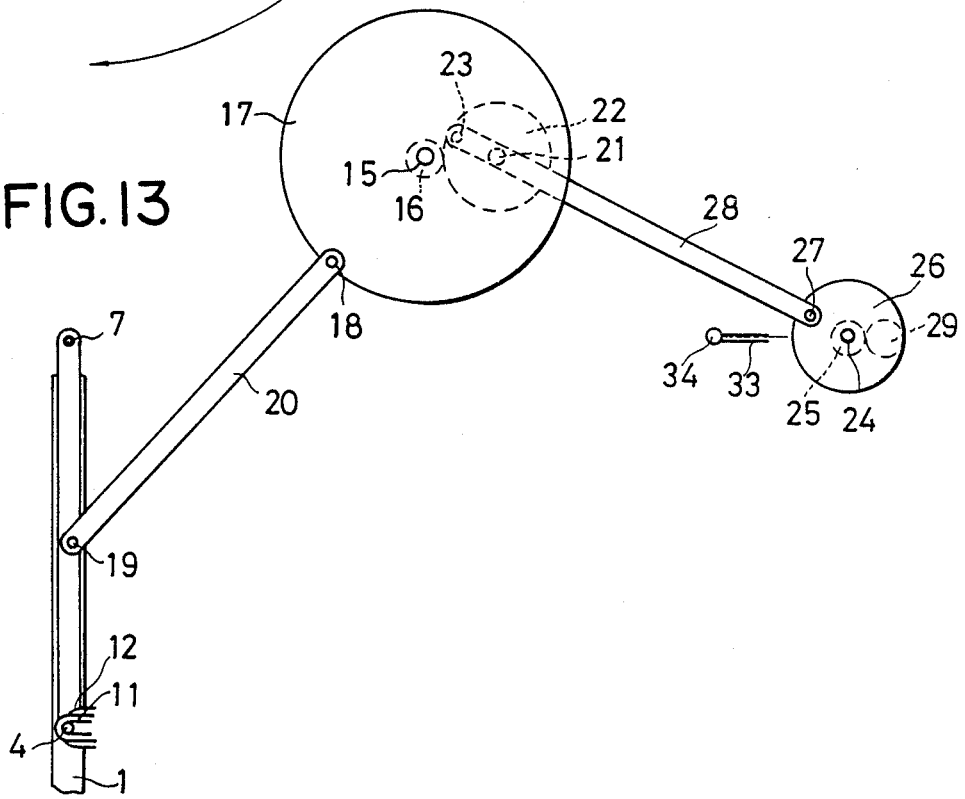
Figure 14:
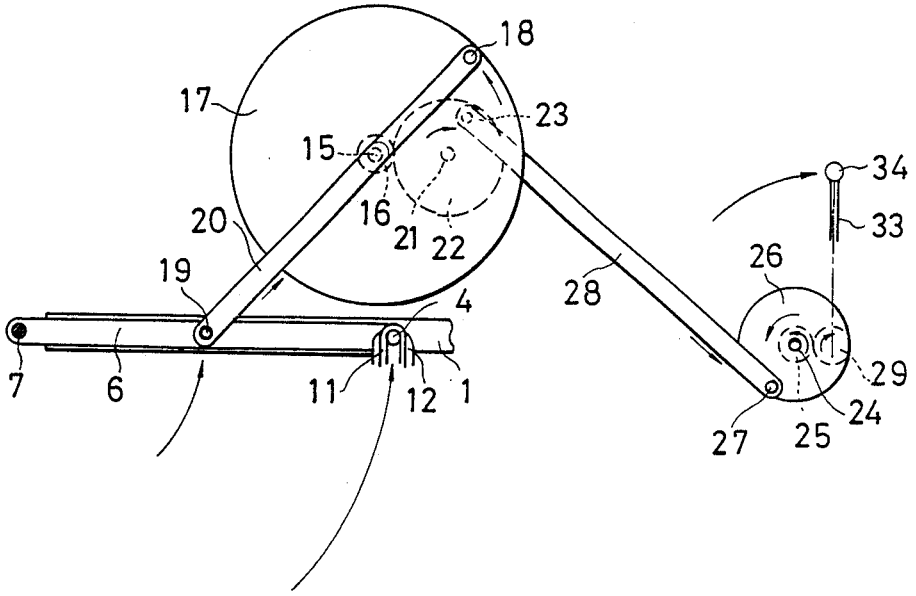

FIG. 13 shows this state. At this time, the operation rod 33 faces the main shaft 7 so that the operation shaft 30 rotates by 90°. The disc 26 rotates by 90° while the disc 17 which has pushed out the connecting rod 20 rotates by 180°.

When one pushes out further the operation rod 33 while passing through the entrance, the disc 26 further rotates counter-clockwise and the position of the pin 27 implanted thereto changes to the opposite side. In consequence, the connecting rod 28 is pulled, on the contrary, this time and the disc 22 further rotates. When the disc 22 rotates until the pin 18 reaches the original position, the door 1 is closed in the reverse sequence.

The door operation when one passes through the entrance from inside to outside is exactly the same as the door operation described above.

In accordance with the present invention having the construction and operation described above, one door rotates while moving horizontally to the right and left, becomes in parallel with the sidewall of the entrance, thereby being open fully, then reverses to the original direction, moves horizontally and is thereafter closed. Therefore, one need not take a step backward or turn sideways when passing through the entrance as has been necessary in the conventional swing door, but can moves straight as such. Accordingly, the handicapped or those who use a wheelchair can smoothly operate the door and pass through the entrance. Since the door is open fully while becoming in parallel with the sidewall of the entrance, the door apparatus of the present invention is most suitable for a narrow passage. Furthermore, the rhythmic door operation is indeed pleasing. One need not change the grip of the knob from opening till closing of the and the door apparatus of the present invention provides great practical values.

While the invention has been particularly shown and described in reference to preferred embodiments thereof, it will be understood by those skilled in the art that changes in form and details may be made therein without departing from the spirit and scope of the invention.

What is claimed is:

1. A door apparatus, comprising:

a frame having a rectangular main frame and sub-frames which expand along a vertical direction of said main frame and extends integrally from said main frame;

a door having a predetermined width, said door being fitted into said frame;

at least one door support shaft which vertically extends in at least one of an upper and lower center of said door in a transverse direction;

a main shaft means for rotatably supporting each door support shaft inside a vertical portion of said main frame;

at least one support arm being extended from at least one of an upper and a lower end portion of said main shaft;

each door support shaft being rotatably supported at a tip of each of said support arms;

at least one vertical support shaft being disposed at a position in said sub-frames where lines connecting axes of said vertical support shaft, said main shaft and said door support shaft substantially form a triangle;

at least one horizontal rocking rod having an elongated hole which extends from a tip of a substantially centered portion of said horizontal rocking rod within a longitudinal direction and into which said door support shaft slidably fits;

said horizonal rocking rod being rotatably supported in the horizontal direction at a base end portion by said vertical support shaft;

at least one rotation limit plate having a tip equipped with a notch groove extending along said elongated hole of said horizonftal rocking rod and having a predetermined width;

said door support shaft having a reduced portion which is fitted into said notch groove;

said rotation limit plate further includes a frame portion into which said horizontal rocking rod is fitted slidably;

a bias spring for urging said rotation limit plate in such a manner that the tip of said rotation limit plate is always in contact with said door support shaft;

at least one rotary shaft being disposed inside said sub-frame on an opposite side to said vertical support shaft;

at least one first small gear being fixed to said rotary shaft;

at least one disc means for rocking said support arm through a connecting rod, said disc means being fixed to said rotary shaft and having a predetermined diameter;

at least one first pin being implanted at an eccentric position of said disc means;

at least one second pin being implanted substantially at the center of said support arm in a longitudinal direction;

said connecting rod being fitted between said first pin and said second pin;

at least one second small gear being fitted to a second rotary shaft for meshing with said first small gear, said second small gear having a diameter substantially twice that of said first small gear;

at least one third pin being implanted to an eccentric position of said at least one second small gear;

at least one other rotary shaft having fixed thereto a third small gear having a diameter substantially equal to that of said first small gear and a second disc having a diameter substantially equal to that of said second small gear;

at least one fourth pin being implanted to an eccentric position of said second disc;

at least one other connecting rod being fitted between said third pin of said second small gear and said fourth pin; and an operation shaft equipped at the upper and lower end portions thereof with at least one fourth small gear for meshing with said third small gear and having substantially the same diameter as that of said first small gear, and having a fitting hole at a substantially centered portion for fitting an operation rod;

said operation shaft being rotatably supported inside a vertical portion of said main frame on an opposite side of said main shaft;

said operation rod being equipped with knobs at both end portions of said operation rod and slidably inserted through said fitting hole of said operation shaft.

* * * * *

UNITED STATES PATENT AND TRADEMARK OFFICE

CERTIFICATE OF CORRECTION

PATENT NO. : 4,897,962

DATED : February 6, 1990

INVENTOR(S) : ITOH

It is certified that error appears in the above-identified patent and that said Letters Patent is hereby corrected as shown below:

On the cover page, Item [30], "Oct. 2, 1988" should read --Feb. 10, 1988--.

Signed and Sealed this

Twenty-first Day of January, 1992

*Attest:*

HARRY F. MANBECK, JR.

*Attesting Officer*

*Commissioner of Patents and Trademarks*